US006739379B2

(12) United States Patent
Kono

(10) Patent No.: US 6,739,379 B2
(45) Date of Patent: May 25, 2004

(54) METHOD AND APPARATUS FOR MANUFACTURING LIGHT METAL ALLOY

(75) Inventor: Kaname Kono, Tokyo (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 09/842,091

(22) Filed: Apr. 26, 2001

(65) Prior Publication Data

US 2001/0023755 A1 Sep. 27, 2001

Related U.S. Application Data

(63) Continuation of application No. 09/330,148, filed on Jun. 11, 1999, now Pat. No. 6,241,001, which is a continuation of application No. 09/139,770, filed on Aug. 25, 1998, now Pat. No. 6,065,526, which is a continuation of application No. 08/873,922, filed on Jun. 12, 1997, now Pat. No. 5,836,372, which is a continuation of application No. 08/522,586, filed on Sep. 1, 1995, now abandoned.

(51) Int. Cl.[7] ..... B22D 17/08; B22D 25/00
(52) U.S. Cl. ..... 164/113; 164/312; 164/900
(58) Field of Search ..... 164/312, 113, 164/900

(56) References Cited

U.S. PATENT DOCUMENTS

| | | | |
|---|---|---|---|
| 2,386,966 A | * | 10/1945 | MacMillin |
| 2,505,540 A | | 4/1950 | Goldhard |
| 2,529,146 A | | 11/1950 | Feitl |

(List continued on next page.)

FOREIGN PATENT DOCUMENTS

| | | |
|---|---|---|
| DE | 196 11 419 | 9/1996 |
| EP | 0 476 843 | 3/1992 |
| EP | 0 761 344 | 3/1997 |

(List continued on next page.)

OTHER PUBLICATIONS

Flemings, "Behavior of Metal Alloys in the Semisolid State," *Metallurgical Transactions B*, vol. 22B, No. 3, Jun. 1991, pp. 269–293.

Material Science & Technology Textbook, Fig. 1–67(b), p 52.

Kalpakjian, Serope, *Manufacturing Processes for Engineering Materials*, 3rd edition, Addison Wesley Longman, Inc., Menlo Park, CA, 1997, pp. 261–263, 265–66.

Flemings et al., "Rheocasting", *Material Science And Engineering*, vol. 25: 103–117, (1976).

Worthy, "Injection Molding Of Magnessium Alloys", *Chemical & Engineering News*, pp. 29–30, (1988).

Tissier et al., "Magnesium Rheocasting: A Study Of processing–Microstructure Interactions", *Journal of Materials Science*, vol. 25:1184–1196, (1990).

(List continued on next page.)

*Primary Examiner*—Kuang Y. Lin
(74) *Attorney, Agent, or Firm*—Foley & Lardner

(57) ABSTRACT

An injection molding system for a metal alloy includes a feeder in which the metal alloy is melted and a barrel in which the liquid metal alloy is converted into a thixotropic state. An accumulation chamber draws in the metal alloy in the thixotropic state through a valve disposed in an opening between the barrel and the accumulation chamber. The valve selectively opens and closes the opening in response to a pressure differential between the accumulation chamber and the barrel. After the metal alloy in the thixotropic state is drawn in, it is injected through an exit port provided on the accumulation chamber. The exit port has a variable heating device disposed around it. This heating device cycles the temperature near the exit port between an upper limit and a lower limit. The temperature is cycled to an upper limit when the metal alloy in the thixotropic state is injected and to a lower limit when the metal alloy in the thixotropic state is drawn into the accumulation chamber from the barrel.

7 Claims, 4 Drawing Sheets

U.S. PATENT DOCUMENTS 2,785,448 A 3/1957 Hodler
3,048,892 A 8/1962 Davis, Jr. et al.
3,106,002 A 10/1963 Bauer
3,123,875 A 3/1964 Madwed
3,172,174 A 3/1965 Johnson
3,189,945 A 6/1965 Strauss
3,201,836 A 8/1965 Nyselius
3,254,377 A 6/1966 Morton
3,268,960 A 8/1966 Morton
3,270,378 A 9/1966 Madwed
3,270,383 A 9/1966 Hall et al.
3,286,960 A 11/1966 Hall et al.
3,319,702 A 5/1967 Hartwig et al.
3,344,848 A 10/1967 Hall et al.
3,447,593 A 6/1969 Nyselius et al.
3,461,946 A * 8/1969 Nyselius ..... 164/113
3,474,854 A 10/1969 Mace
3,491,827 A 1/1970 Mace
3,529,814 A 9/1970 Werner
3,550,207 A 12/1970 Strauss
3,693,702 A 9/1972 Piekenbrink et al.
3,773,873 A 11/1973 Spaak et al.
3,810,505 A 5/1974 Cross
3,814,170 A 6/1974 Kahn
3,874,207 A 4/1975 Lemelson
3,893,792 A 7/1975 Laczko
3,902,544 A 9/1975 Flemings et al.
3,936,298 A 2/1976 Mehrabian et al.
3,976,118 A 8/1976 Kahn
4,049,040 A 9/1977 Lynch
4,088,178 A 5/1978 Ueno et al.
4,168,789 A 9/1979 Deshais et al.
4,212,625 A 7/1980 Shutt
4,287,935 A 9/1981 Ueno et al.
4,330,026 A 5/1982 Fink
4,347,889 A 9/1982 Komatsu et al.
4,387,834 A * 6/1983 Bishop ..... 198/615
4,434,839 A 3/1984 Vogel
4,436,140 A 3/1984 Ebisawa et al.
4,473,103 A 9/1984 Kenney et al.
4,476,912 A 10/1984 Harvill
4,510,987 A 4/1985 Collot
4,534,403 A 8/1985 Harvill
4,537,242 A 8/1985 Pryor et al.
4,559,991 A 12/1985 Motomura et al.
4,586,560 A 5/1986 Ikeya et al.
4,635,706 A 1/1987 Behrens
4,687,042 A 8/1987 Young
4,694,881 A 9/1987 Busk
4,694,882 A 9/1987 Busk
4,730,658 A 3/1988 Nakano
4,771,818 A 9/1988 Kenney
4,828,460 A 5/1989 Saito et al.
4,834,166 A 5/1989 Nakano
4,884,621 A 12/1989 Ban et al.
4,898,714 A 2/1990 Urban et al. ..... 422/133
4,952,364 A 8/1990 Matsuda et al. ..... 264/40.1
4,997,027 A 3/1991 Akimoto
5,040,589 A 8/1991 Bradley et al.
5,109,914 A 5/1992 Kidd et al.
5,143,141 A 9/1992 Frulla
5,144,998 A 9/1992 Hirai et al.
5,161,598 A 11/1992 Iwamoto et al.
5,181,551 A 1/1993 Kidd et al.
5,186,236 A 2/1993 Gabathuler et al.
5,191,929 A 3/1993 Kubota et al.
5,205,338 A 4/1993 Shimmell
5,244,033 A 9/1993 Ueno
5,375,645 A 12/1994 Brueker et al.
5,380,187 A 1/1995 Fujikawa
5,388,633 A 2/1995 Mercer, II et al.
5,394,931 A 3/1995 Shiina et al.
5,413,644 A 5/1995 Marder et al.
5,501,266 A 3/1996 Wang et al.
5,531,261 A 7/1996 Yoshida et al.
5,533,562 A 7/1996 Moschini et al.
5,571,346 A 11/1996 Bergsma
5,575,325 A 11/1996 Sugiura et al.
5,577,546 A 11/1996 Kjar et al.
5,601,136 A 2/1997 Shimmell
5,622,216 A 4/1997 Brown
5,623,984 A 4/1997 Nozaki et al.
5,630,463 A 5/1997 Shimmell
5,630,466 A 5/1997 Garat et al.
5,638,889 A 6/1997 Sugiura et al.
5,657,812 A 8/1997 Walter et al.
5,662,159 A 9/1997 Iwamoto et al.
5,664,618 A 9/1997 Kai et al.
5,665,302 A 9/1997 Benni et al.
5,680,894 A 10/1997 Kilbert
5,685,357 A 11/1997 Kato et al.
5,697,422 A 12/1997 Righi et al.
5,697,425 A 12/1997 Nanba et al.
5,701,942 A 12/1997 Adachi et al.
5,704,411 A 1/1998 Suzuki et al.
5,716,467 A 2/1998 Marder et al.
5,730,198 A 3/1998 Sircar
5,730,202 A 3/1998 Shimmell
5,735,333 A 4/1998 Nagawa
5,770,245 A 6/1998 Takizawa et al. ..... 425/549
5,836,372 A 11/1998 Kono
5,839,497 A 11/1998 Fujino et al. ..... 164/113
5,861,182 A * 1/1999 Takizawa et al.
5,913,353 A 6/1999 Riley et al.
5,983,976 A 11/1999 Kono
6,065,526 A 5/2000 Kono
6,135,196 A 10/2000 Kono
6,241,001 B1 6/2001 Kono
6,276,434 B1 8/2001 Kono
6,283,197 B1 9/2001 Kono
6,284,167 B1 9/2001 Fujikawa

FOREIGN PATENT DOCUMENTS

FR 1447606 11/1966
JP 59-152826 8/1984
JP 1166874 6/1989
JP 1-178345 * 7/1989
JP 1-192447 * 8/1989
JP 2-202420 8/1990
JP 2-274360 11/1990
JP 5-8016 1/1993
JP 05 008017 1/1993
JP 5-285626 * 11/1993
JP 5-285627 11/1993
JP 6-306507 11/1994
JP 7-51827 2/1995
JP 8-72110 3/1996
JP 8-174172 7/1996
JP 8-252661 10/1996
JP 9-103859 4/1997
JP 9-155524 6/1997
JP 9-155526 6/1997
JP 9-155527 6/1997
JP 9-295122 11/1997
TW 153528 3/1991
WO WO 92/13662 8/1992
WO 97/21509 6/1997
WO 97/45218 12/1997
WO 99/28065 6/1999
WO 99/50007 10/1999

OTHER PUBLICATIONS

Carnahan et al., "New Manufacturing Process For Metal Matrix Composite Synthesis", *Fabrication Of Particulates Reinforced Metal Composites, Proceedings Of An International Conferences*, pp. 101–105, (1990).

Pasternak et al., Semi–Solid Production processing Of Magnesium Alloys By thixomolding', *Proceedings Of The Second International Conference On The Semi–Solid Processing Of Alloys And Composites*, pp. 159–169, (1992).

Staff Report, "Semi–Solid Metalcasting Gains Acceptance, Applications", *Foundry Management & Technology*, pp. 23–26, (1995).

R.D. Carnalman et al., "Advances In Thisomolding", 52$^{nd}$ Annual World Magnesium Conference, May 17–19, (1994.

R.D. Carnahan et al., "New Manufacturing Process For Metal Matrix Composite Synthesis".

"Plastic processing Technology Book", Published in Japan.

"Advertisement Foro Sodick Tupal Injection Machine", May 1997, and "Sodick Advertising Material" (no date) and English Translations.

Sodick, Seminar Material, Japan, Jul. 1995, by M. Fujikawa and English Translation.

"Semi–Solid Metalcasting", Foundry Management and Technology, Japan, Nov. 1995.

"Injection Molding of Magnesium Alloys", Chemical Engineering News, Jun. 6, 1988.

R. Mehrabian et al., "Castng IN The Liquid–Solid Region," New Trend In Materials Processing, Papers presented at a seminar of AST, Oct. 19 and 20, 1974, ASM, 98–127 (1974).

M. Suery et al., "Effect of Strain Rate On Deformation Behavior Of Semi–Solid Dendritic alloys", *Metal Trans. A.*, vol. 13A, No. 10: 1809–1819, (1982).

M.C. Flemings et al., "Rheocasting", *McGraw–Hill Yearbook of Science and Technology*, pp. 49–59, (1978).

V. Laxmanan et al., "Deformation of Semi–Solid Sn–15 Pct. Pb Alloy", *Metall. Trans. A.*, vol. 11A: 1927–1937, (1980).

T. Matsumiya et al., "Modeling of Continuous Strip Production By Rheocasting", *Metall. Trans. B.*, vol. 12 B: 17–31, (1981).

S.B. Brown et al., "Net Shape Forming via Semi–Solid Processing", *Advanced Materials & Processes*, vol. 143(1):36–40, (1993).

* cited by examiner

METHOD AND APPARATUS FOR MANUFACTURING LIGHT METAL ALLOY

This application is a continuation of Ser. No. 09/330,148, filed Jun. 11, 1999 now U.S. Pat. No. 6,241,001, which is a continuation of Ser. No. 09/139,770, filed Aug. 25, 1998, now U.S. Pat. No. 6,065,526, which is a continuation of Ser. No. 08/873,922, filed Jun. 12, 1997, now U.S. Pat. No. 5,836,372, which is a continuation of Ser. No. 08/522,586, filed Sep. 1, 1995, now abandoned.

BACKGROUND OF THE INVENTION

1. Field of the Invention

The invention relates to a method and apparatus for manufacturing metal alloys, more particularly to a method and apparatus for manufacturing a light metal alloy by the process of injection molding the metal alloy when it is in a thixotropic (semi-solid) state.

2. Description of the Related Art

One conventional method used to produce molds of metal alloys is the die cast method. The die cast method is disclosed in U.S. Pat. Nos. 3,902,544 and 3,936,298, both of which are incorporated by reference herein. The die cast method uses liquid metal alloys during casting and as a consequence, metal alloys produced from this method have low densities. Metal alloys having low densities are not desirable because of their lower mechanical strength, higher porosity, and larger micro shrinkage. It is thus difficult to accurately dimension molded metal alloys, and once dimensioned, to maintain their shapes. Moreover, metal alloys produced from die casting have difficulty in reducing the resilient stresses developed therein.

The thixotropic method improves upon the die casting method by injection molding a metal alloy from its thixotropic (semi-solid) state rather than die casting it from its liquid state. The result is a metal alloy which has a higher density than one produced from the die casting method.

A method and apparatus for manufacturing a metal alloy from its thixotropic state is disclosed in U.S. Pat. No. 5,040,589, which is incorporated by reference herein. A method of converting a metal alloy into a thixotropic state by controlled heating is disclosed in U.S. Pat. Nos. 4,694,881 and 4,694,882, both of which are incorporated by reference herein.

The system disclosed in U.S. Pat. No. 5,040,589 is an in-line system, in which the conversion of the metal alloy into a thixotropic state and the pressurizing of the same for the purposes of injection molding is carried out within a single cylindrical housing. With such a system, it is difficult to control the molding conditions, i.e., temperature, pressure, time, etc., and as a result, metal alloys of inconsistent characteristics are produced.

Moreover, the system of U.S. Pat. No. 5,040,589 requires that the metal alloy supplied to the feeder be in pellet form. As a consequence, if a mold of undesired characteristics are produced by its system, recycling of the defective molds is not possible unless the defective molds are recast in pellet form.

An improved system for manufacturing light alloy metals, which is capable of accurately producing molded metal alloys of specified dimensions within a narrow density tolerance, is desired. Further, a production process for light alloy metals which can consistently produce molded metal alloys of desired characteristics, and which can easily accommodate recycling of defective molds would represent a substantial advance in this art.

SUMMARY OF THE INVENTION

An object of the invention is to provide a method and apparatus for producing metal alloys through injection molding.

Another object of the invention is to provide an improved injection molding system for metal alloys which is capable of producing molded metal alloys of accurate dimensions within a narrow density tolerance.

Still another object of the invention is to provide an injection molding system for light alloy metals which is capable of producing light alloy metals of desired characteristics in a consistent manner.

Still another object of the invention is to provide an injection molding system for light alloy metals which accommodates recycling of defective molds easily.

These and other objects are accomplished by an improved injection molding system for metal alloys in which the steps of melting the metal alloy, converting the metal alloy into a thixotropic state, and injecting the metal alloy in the thixotropic state into a mold are carried out at physically separate locations.

The improved system comprises a feeder in which the metal alloy is melted and a barrel in which the liquid metal alloy is converted into a thixotropic state. An accumulation chamber draws in the metal alloy in the thixotropic state through a valve disposed in an opening between the barrel and the accumulation chamber. The valve selectively opens and closes the opening in response to a pressure differential between the accumulation chamber and the barrel.

After the metal alloy in the thixotropic state is drawn in, it is injected through an exit port provided on the accumulation chamber. The exit port has a variable heating device disposed around it. This heating device cycles the temperature near the exit port between an upper limit and a lower limit. The temperature is cycled to an upper limit when the metal alloy in the thixotropic state is injected and to a lower limit when the metal alloy in the thixotropic state is drawn into the accumulation chamber from the barrel.

A piston-cylinder assembly supplies the accumulation chamber with the pressure necessary to inject the metal alloy in the thixotropic state and with the suction necessary to draw in the metal alloy in the thixotropic state from the barrel.

Additional objects and advantages of the invention will be set forth in the description which follows. The objects and advantages of the invention may be realized and obtained by means of instrumentalities and combinations particularly pointed out in the appended claims.

BRIEF DESCRIPTION OF THE DRAWINGS

The invention is described in detail herein with reference to the drawings in which.

DETAILED DESCRIPTION OF THE PREFERRED EMBODIMENTS

In the discussion of the preferred embodiment which follows, a metal alloy is produced by injection molding from a magnesium (Mg) alloy ingot. The invention is not limited to a Mg alloy and is equally applicable to other types of metal alloys. Further, specific temperature and temperature ranges cited in the description of the preferred embodiment are applicable only to a system producing a Mg alloy, but could readily be modified in accordance with the principles of the invention by those skilled in the art in order to accommodate other alloys. For example, a Zinc alloy becomes thixotropic at about 380° C.–420° C.

Figure 1:
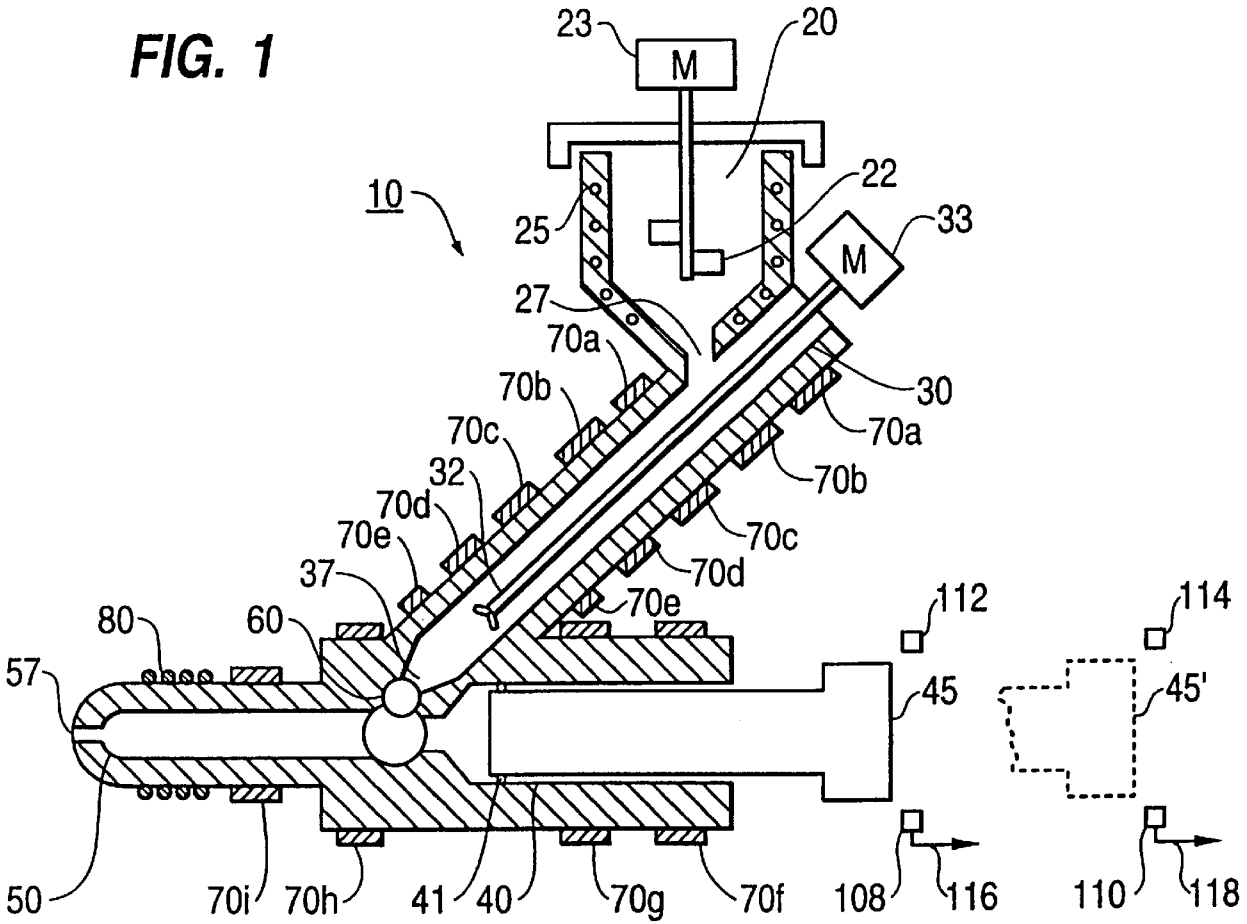
FIG. 1 is a schematic illustration of a side view of the injection molding system according to a first embodiment of the invention.

FIG. 1 illustrates an injection molding system 10 according to a first embodiment of the invention. The system 10 has four substantially cylindrical sections—a feeder 20, a barrel 30, a cylinder 40, and an accumulation chamber 50. A metal alloy, e.g., Mg alloy, is supplied to the feeder 20. The feeder 20 is provided with a mixer 22 and a heating element 25 disposed around its outer periphery. The heating element 25 may be of any conventional type and operates to maintain the feeder 20 at a temperature high enough to keep the metal alloy supplied through the feeder 20 in a liquid state. For a Mg ingot, this temperature would be about 600° C. or greater. The mixer 22 is driven by a stirrer motor 23 for the purposes of evenly distributing the heat from the heating element 25 to the metal alloy supplied to the feeder 20.

The liquid metal alloy is subsequently supplied to the barrel 30 by way of gravity through an opening 27 which may optionally be supplied with a valve serving as a stopper (not shown). The barrel 30 has a plurality of heating elements 70*a–e* disposed along the length of the barrel 30. The heating elements 70*a–e* maintain the barrel at temperatures at and slightly below the melting point of the liquid metal alloy supplied from the feeder 20. For an injection molding system 10 designed for a Mg ingot, heating pairs 70*a* and 70*b* would be maintained at a temperature of about 600° C.; a heating pair 70*c* would be maintained at a temperature of about 580° C.; and heating pairs 70*d* and 70*e* would be maintained at a temperature of about 550° C. Heating pairs 70*a–*70*e* induce a thermal slope to the metal alloy flowing through the barrel 30.

The purpose of the thermal slope is to convert liquid metal alloy entering the barrel 30 into a metal alloy in the thixotropic state at the exit of the barrel 30.

The barrel 30 also has a physical slope or an inclination. The inclination, preferably between 30° and 90°, is necessary to supply the metal alloy in the thixotropic state to the accumulation chamber 50 by the force of gravity. The barrel 30 is also provided with a mixer 32 which is driven by a stirrer motor 33. The mixer 32 is provided to assure that the ratio of solid and liquid is consistent throughout the metal alloy in the thixotropic state. Plural mixing blades attached to the rotating shaft may of course be used.

The metal alloy in the thixotropic state exits the barrel 30 into an accumulation chamber 50 through a ball valve 60. The ball valve 60 operates in response to a pressure differential between the accumulation chamber 50 and the barrel 30. The pressure within the barrel 30 remains somewhat constant, but the pressure within the accumulation chamber 50 is determined by the position of a piston 45 disposed in the cylinder 40. When the piston 45 is displaced inwardly, the pressure in the accumulation chamber 50 increases (and becomes higher than that of the barrel 30 ) and the ball valve 60 closes off an opening 37 between the barrel 30 and the accumulation chamber So. When the piston 45 is displaced outwardly, the pressure in the accumulation chamber 50 decreases and is lower than that of the barrel 30, and the ball valve 60 opens. A seal 41, e.g., an O-ring, is provided at the outer periphery of the piston 45 to maintain the pressure within the accumulation chamber 50 and to prevent leakage of metal alloy in the thixotropic state drawn into the accumulation chamber 50.

Figure 2A:
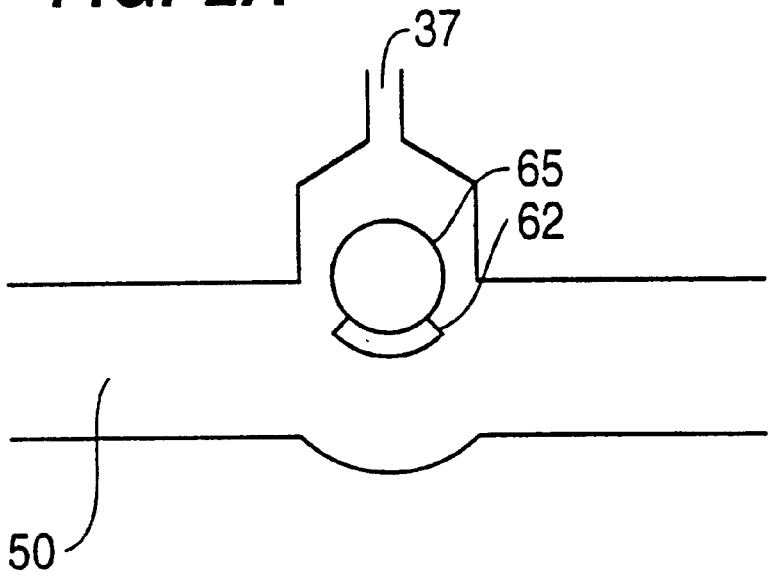
FIGS. 2A and 2B illustrates the two positions of a ball valve used in the injection molding system of the invention.
Figure 2B:
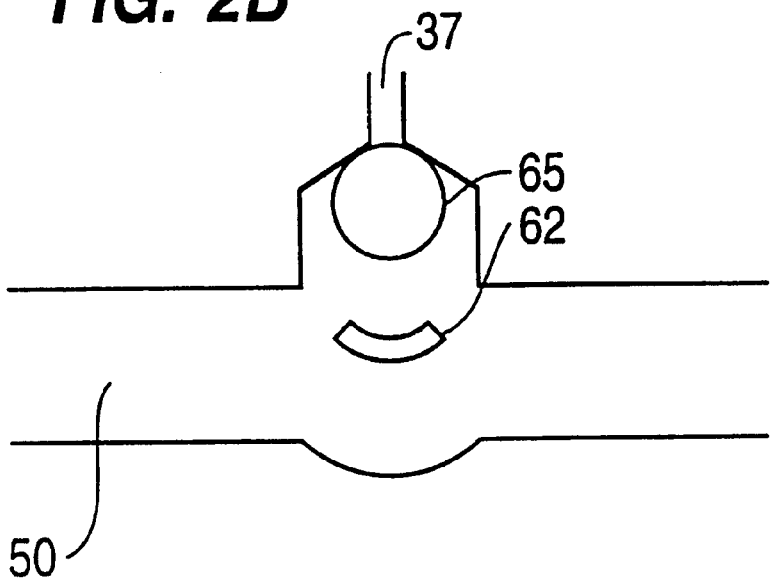

The operation of the ball valve 60 is shown in greater detail in FIGS. 2A and 2B. FIG. 2A shows the position of the ball valve 60 when the piston 45 is displaced outwardly. In this case, the opening 37 between the barrel 30 and the accumulation chamber 50 is opened as the ball element 65 of the ball valve 60 moves away from the opening 37. A ball valve stop 62 is provided to confine the ball valve movement away from the opening 37. On the other hand, when the piston 45 is displaced inwardly, as shown in FIG. 2B, the pressure inside the accumulation chamber 50 increases and the ball element 65 of the ball valve 60 is forced to lodge up against the opening 37 and thereby close off fluid communication between the barrel 30 and the accumulation chamber 50.

In a slightly different embodiment, the ball valve 60 may be provided with a biasing element, e.g., a spring. In such a case, the ball element 65 may be biased towards either the open or the closed position. It is preferable to provide such a biasing element in larger injection molding systems for producing metal alloys.

In still another slightly different embodiment, the ball valve 60 may be electronically controlled, in which the opening and closing of the ball valve would be synchronized with the displacement motion of the piston 45.

As shown in FIG. 1, heating elements 70*f–*70*i* and heating element 80 are also provided along the lengths of the cylinder 40 and the accumulation chamber 50. Heating elements referenced and prefixed by the numeral 70 are resistance heating elements. In the preferred embodiment of the injection molding system for producing a Mg alloy, heating pairs 70*f–*70*i* are preferably maintained at temperatures of 550–570° C. in order to maintain the metal alloy in a semi-solid state.

The heating element 80 is an induction coil heater and is used to cycle the temperature at an exit port 57 of the accumulation chamber 50 between temperatures 550° C. and 580° C. One cycle is approximately 30 seconds to one minute. As the temperature at the exit port 57 is cycled, the characteristic of the metal alloy in the thixotropic state near the exit port 57 is varied. For example, the exit port 57 at a temperature of 550° C. would cause the metal alloy in the thixotropic state to have a higher solid to liquid ratio compared with the situation in which the exit port 57 is at a temperature of 580° C.

The purpose of raising the solid to liquid ratio of the metal alloy in the thixotropic state at the exit port 57 during the outward stroke of the piston 45 is to solidify the metal alloy in the thixotropic state near the exit port 57 sufficiently to function as a plug for the accumulation chamber 50. During the inward stroke of piston 45, the temperature at the exit port 57 cycled to a higher temperature (e.g., 580° C.) so that the metal alloy in the thixotropic state at the exit port 57 will take on a characteristic which a lower solid/liquid ratio and thereby allow the metal alloy in the thixotropic state to be easily injected through the exit port 57.

The injection of the metal alloy in the thixotropic state is made through the exit port 57 into a mold (not shown). Molds of desired characteristics are retained and molds of undesired characteristics are recycled to the feeder 20. The defective molds (e.g., density of mold outside a predetermined range, surface blemish, etc.) are recycled "as is" and need not be reformed into any particular shape, since the system according to the invention melts the metal alloy supplied thereto before further processing.

The control of the heating elements 70, the cycling of the induction coil heating element 80, and the timing of the piston stroke are implemented electronically based on the following. The heating elements 70 are resistance heating elements. Electric current is supplied through the heating elements 70 sufficiently to maintain the heating elements 70 at their desired temperatures. The cycling of the induction coil heating element 80 is synchronized with the piston stroke. An outward piston stroke should be synchronized with the lower temperature and an inward piston stroke should be synchronized with the upper temperature. The control of the piston stroke is accomplished in a conventional manner.

The following table gives representative dimensions for a large, medium and small injection molding systems for metal alloys.

| System Size | Barrel 30 | Cylinder 40 | Chamber 50 | Port 57 |
|---|---|---|---|---|
| Large | d: 60<br>l: 120 | d: 52<br>l: 1500 | d: 52<br>l: 1500 | d: 12 |
| Medium | d: 50<br>l: 110 | d: 36<br>l: 700 | d: 36<br>l: 700 | d: 10 |
| Small | d: 40<br>l: 100 | d: 32<br>l: 700 | d: 32<br>l: 700 | d: 10 |

The dimensions given in the above table are exemplary and are provided to give guidance on how scaling for large, medium and small systems should be carried out. In the table, d indicates the inside diameter and 1 indicates the length. All dimensions are in millimeters (mm).

Figure 3:
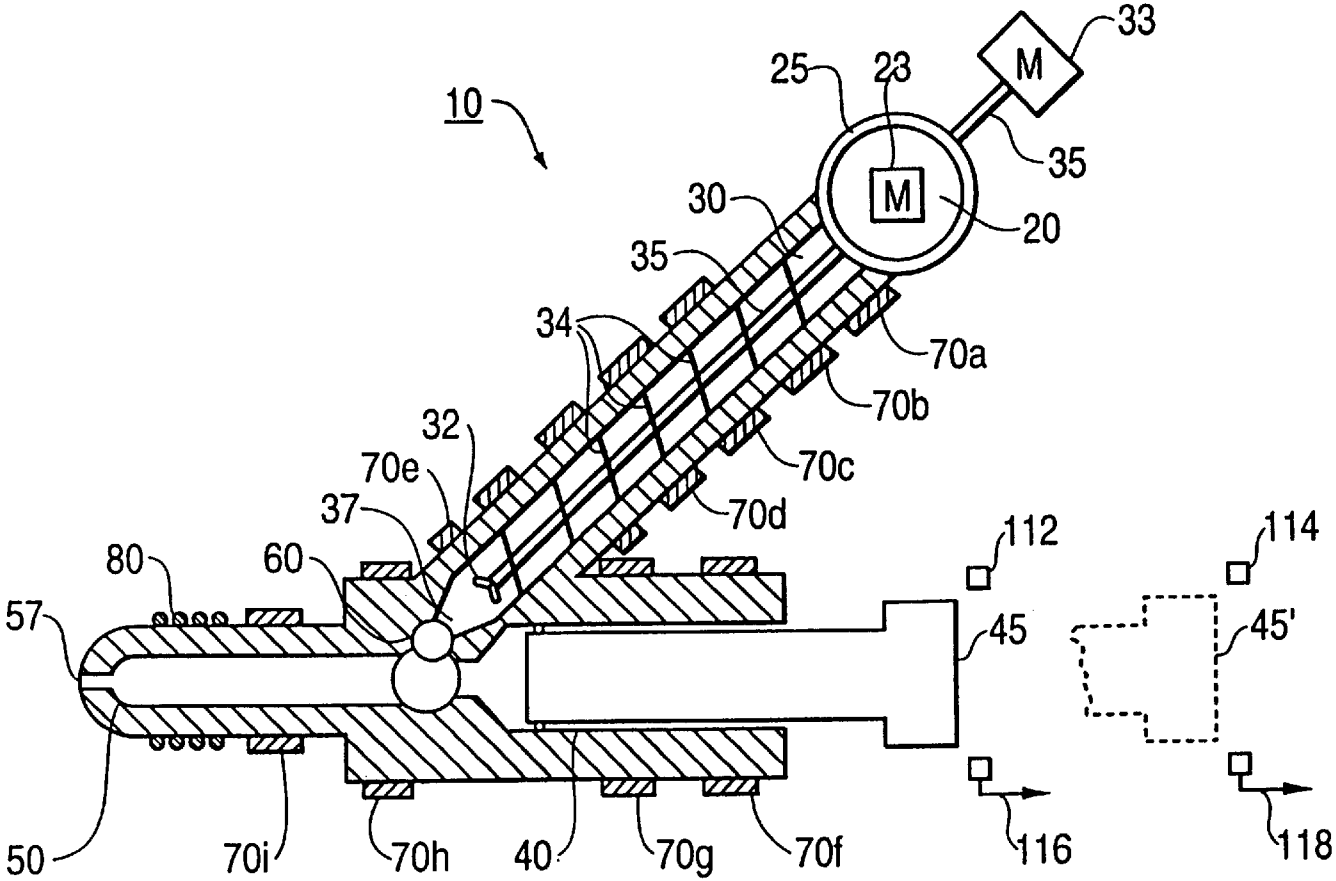
FIG. 3 is a schematic illustration of a top view of the injection molding system according to a second embodiment of the invention.

FIG. 3 is a top view illustration of a second embodiment of the injection molding system of the present invention. This embodiment is identical to the first embodiment except for the barrel 30. The barrel 30 in FIG. 3 is positioned horizontally with respect to the cylinder 40 and the accumulations chamber 50. Since gravity no longer supplies the force necessary to advance the metal alloy in the thixotropic state flowing in the barrel 30, a plurality of screw elements 34 driven by the motor 33 is provided. The screw elements 34 advance the metal alloy in the thixotropic state to accumulate near the opening 37 adjacent to the ball valve 60. The mixer 32 is provided on the same shaft 35 which rotates the screw elements 34. (In FIG. 3, the shaft 35 is shown to be separated by the feeder 20, because the shaft 35 runs underneath the feeder 20.) Therefore, the motor 33 operates to power both the screw elements 34 and the mixer 32. Other features of this embodiment are identical to the first embodiment.

Both the first and second embodiments may also have a pressure device attached to the barrel 30 to slightly pressurize the barrel. Such pressure is much less than the pressure used in the cylinder 40 and the accumulation chamber 50.

In all of the embodiments of the invention it is desired to have a temperature gradient between the portion of the barrel 30 in which the metal alloy enters the barrel 30 and the portion of the opening 37 where the metal alloy in the thixotropic state exits the barrel 30.

Figure 4:
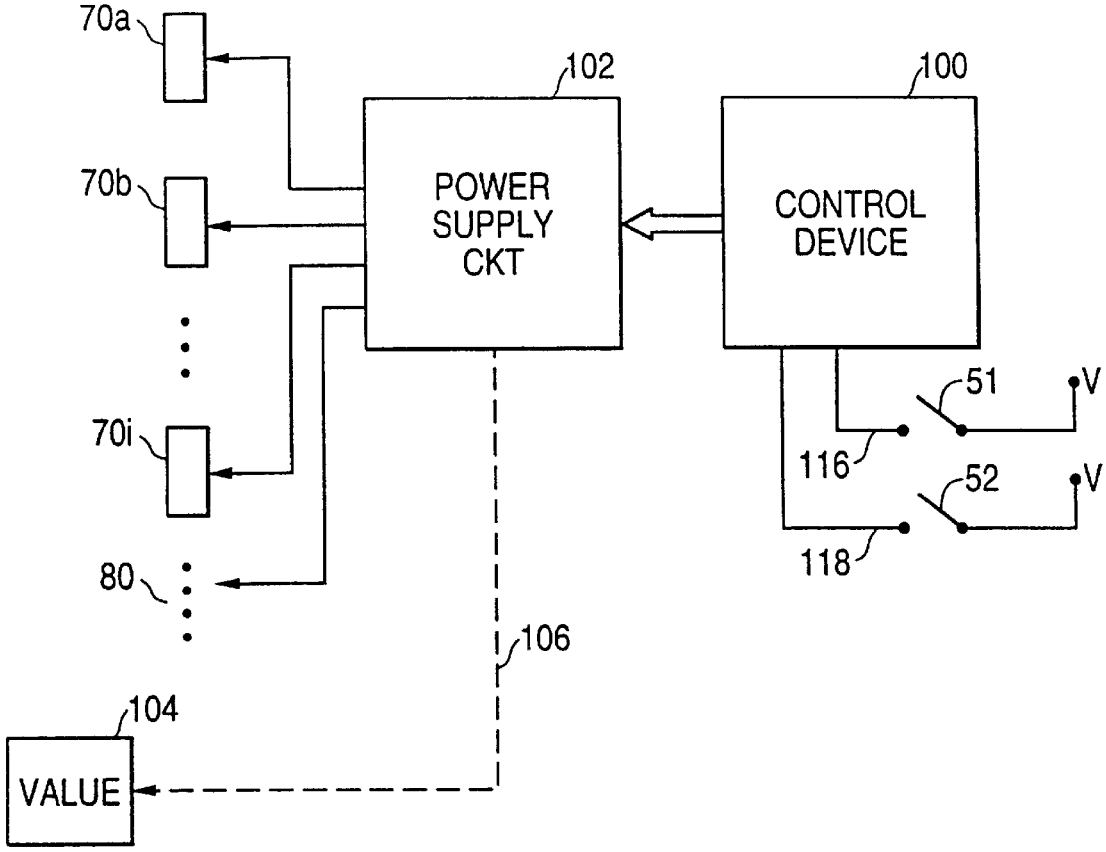
FIG. 4 is a block diagram of an exemplary control circuit for the heating elements of the injection molding system according to the invention.
Figure 5:
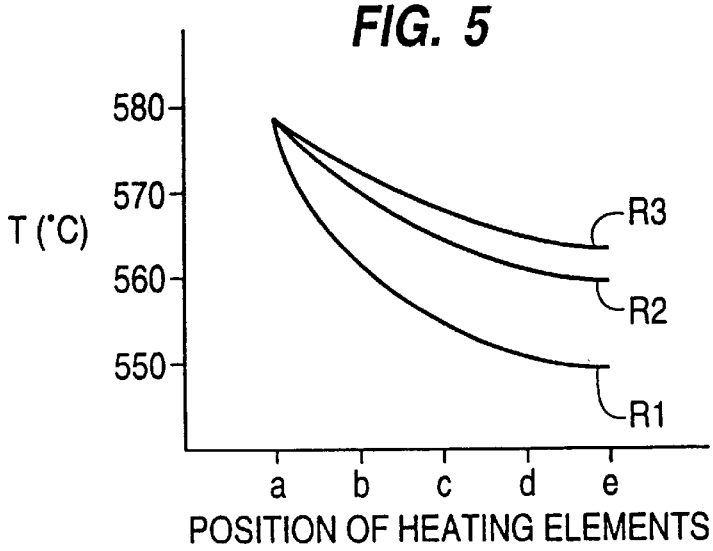
FIG. 5 shows characteristic curves, corresponding to three solid/liquid ratios, achievable by the control circuit of FIG. 4.

The temperature gradient is necessary in order to produce the metal alloy in the thixotropic state. An exemplary manner of producing the temperature gradient is shown in FIGS. 4 and 5. As seen in FIG. 4, the control apparatus includes a control device 100 and a power supply circuit 102. The power supply circuit is connected to each of the heating element pairs 70*a*–70*i* and supplies different currents for the resistive heaters. Thus, a larger current (or a current supplied for a longer time, or a combination of current value and time) supplied from the power supply to a particular heating element or pair, say pair 70*a*, results in a larger heating effect in the resistive heater pair.

Each of the heating pairs 70*a*–70*e* heats a respective localized zone in the barrel 30. By controlling the current (and/or time) supplied to the heating pairs 70*a*–70*e*, the amount of heat in each zone of the barrel 30 adjacent the respective heating pair may be controlled. While only five heating pairs 70*a*–70*e* are shown provided for the barrel 30, the barrel 30 is preferably equipped with between seven to ten separately controllable heating zones, each corresponding to a separately controllable heating pair.

Preferably, the control device is programmable so that the desired solid/liquid ratio characteristic R1, R2, R3 of the metal alloy in the thixotropic state may be achieved as seen in FIG. 5. Control device 100 may, for example, comprise a microprocessor (with an associated input device such as a keyboard, not shown) which may be easily and quickly reprogrammed to changed the resultant solid/liquid ratio depending on the type of finished mold product desired. FIG. 5 shows three characteristic curves for three different values, R1, R2, and R3 of the solid/liquid ratio. The abscissa of the graph in FIG. 5 is labeled "a, b, . . . e" corresponding to the position of the respective heating pairs 70*a*, 70*b* . . . 70*e* in FIGS. 1 and 3. The ordinate of FIG. 5 represents the varying temperature range which may be employed. It should be appreciated that all values of the temperature used for the heating pairs 70*a*, 70*b* . . . 70*e* are within the range of 550° C. to 580° C. necessary to maintain the metal alloy in its thixotropic state.

Further, it will be noted that the values of the temperature associated with the position of heating pair 70*a* are approximately the same (580° C.) for all the curves since these values are near the value of the metal alloy as it enter the barrel 30 from the feeder 20. By selecting a ratio R1, as contrasted with R3, one may achieve a larger solid/liquid ratio and thus achieve a more dense resultant metal alloy in the thixotropic state and a more dense molded product. The heating element pairs 70*f*–70*i* are all typically controlled to have a temperature equal to the temperature of the heating pair 70*e*, i.e., there is no temperature gradient between heating pairs 70*f*–70*i*.

FIG. 4 also shows the use of position detecting devices used with an electrically actuated valve 104 which may be used instead of the ball valve 60. The electrically actuated valve 104 has two positions, one permitting communication between the barrel 30 and accumulation chamber 50 and the other blocking such communication. The valve is controlled by the power supply circuit as shown by the dotted line 106. Two limit switches S1 and S2 are used to open and close valve 104. These limit switches are shown implemented in the form of two photodetectors 108 and 110 and associated light sources 112 and 114 (i.e., photodiodes). Detector 108 provides an output signal along line 116 to the control device 100 whenever the light beam from the source 112 is interrupted by the piston 45 moving outwardly (to the right in FIGS. 1 and 3) and thus acts as a first switch S1. In response to this signal the control valve 104 is opened permitting the metal alloy in the thixotropic state to enter the accumulation chamber 50 from the barrel 30. Also, this same signal may be used to direct the power supply circuit to cool down the induction coil heating element 80 to a relatively low temperature (550° C.) thus permitting the solid/liquid ratio of the metal alloy in the thixotropic state which is adjacent the exit port 57 to increase and thus form a plug.

When the piston 45 reaches its outermost position as shown by the dotted lines 45 in FIGS. 1 and 3, the econd limit switch (light source 114 and photodetector 110) is actuated for delivering a signal along line 118 to the control device 100 thus acting as a second switch S2 (e.g., see FIG. 4). In response to this signal, the control device 100 directs the power supply circuit 102 to close valve 104 and to raise the temperature of the induction coil heating element 80 to thereby lower the solid/liquid ratio of the metal alloy in the thixotropic state in the region of the exit port 57 and unplug the exit port 57 to permit injection to take place upon the inward movement of the piston 45.

In the above described manner, the gradient temperature may be selectively controlled, and the induction coil heating element 80 may be controlled in synchronism with the movement of the piston 45. Moreover, in the case of an electronically actuated valve, the valve opening and closing may also be controlled in synchronism with the movement of the piston 45.

While particular embodiments according to the invention have been illustrated and described above, it will be clear that the invention can take a variety of forms and embodiments within the scope of the appended claims. For example, the photodetectors and light sources may be replaced by mechanical micro-switches, or the position of the piston 45 may be inferred by measuring pressure changes within the accumulation chamber 50. Alternatively, an encoder (e.g. photo-encoder) may be used to detect the position of the shaft 45.

What is claimed is:

1. A method of injecting a metal into a mold, comprising:

introducing the metal into a first chamber;

heating the metal in the first chamber;

rotating a stirrer in the first chamber to advance the metal from the first chamber into a second chamber through a passage which connects the first chamber and the second chamber, wherein the second chamber is oriented substantially horizontally and a longitudinal axis of the second chamber is located in a different gravitationally vertical plane than a gravitationally vertical plane in which a longitudinal axis of the first chamber is located; and injecting the metal from the second chamber through an exit port into the mold.

2. The method of claim 1, wherein the step of injecting comprises advancing a piston in the second chamber to inject the metal from the second chamber into the mold.

3. The method of claim 1, wherein:

the metal passes through the passage comprising a opening between the first and the second chamber; and the opening has a smaller diameter than a diameter of the first and the second chambers.

4. The method of claim 3, wherein the longitudinal axes of the first and the second chambers are located in the same horizontal plane.

5. The method of claim 1, wherein the metal is a magnesium alloy.

6. The method of claim 5, wherein the metal is maintained in a thixotropic state in the first and the second chambers.

7. The method as claimed in claim 1, wherein the injected metal solidifies into a metal part in the mold.

* * * * *